United States Patent [19]

Kachaylo

[11] 4,039,190

[45] Aug. 2, 1977

[54] GAME TOY UTILIZING A SPINNING TOP

[76] Inventor: John Kachaylo, 5555 Hollywood Blvd., Apt. 221, Los Angeles, Calif. 90028

[21] Appl. No.: 629,713

[22] Filed: Nov. 7, 1975

[51] Int. Cl.[2] ..... A63F 9/16

[52] U.S. Cl. ..... 273/109; 273/108

[58] Field of Search ..... 273/108, 109, 110, 142 R, 273/147

[56] References Cited

U.S. PATENT DOCUMENTS

| | | | |
|---|---|---|---|
| 607,560 | 7/1898 | Zolper | 273/108 |
| 697,574 | 4/1902 | Walenta | 273/108 |
| 934,175 | 9/1909 | Hotchkiss | 273/108 |
| 1,364,632 | 1/1921 | Harrington | 273/110 |
| 1,470,872 | 10/1923 | Ovenshire | 273/108 |

*Primary Examiner*—Richard J. Apley
*Attorney, Agent, or Firm*—William P. Green

[57] ABSTRACT

A game toy including a board having an upwardly facing support surface on which a spinning top is receivable, along with one or more shiftable parts which are movable to different positions on the support surface by the top as it spins. Preferably, one of the shiftable parts has an opening within which the top is received in a relation controlling movement of that part, while the other shiftable part is desirably disposed about the first part and movable relative thereto.

12 Claims, 5 Drawing Figures

FIG. 1
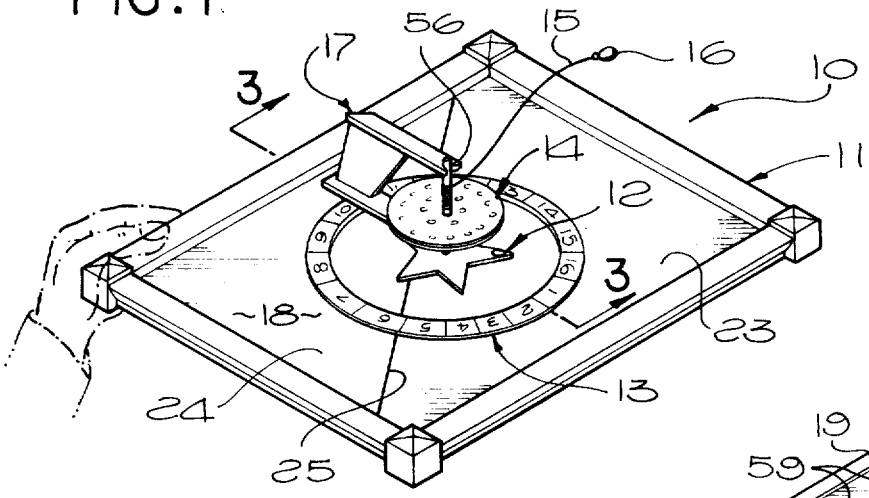
FIG. 5
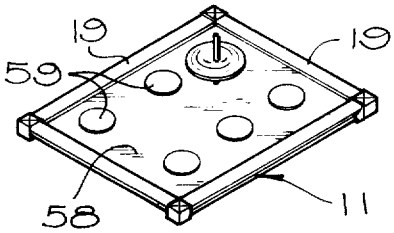
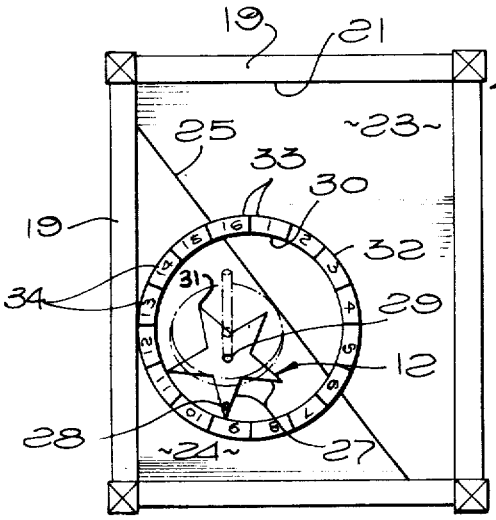
FIG. 2
FIG. 4
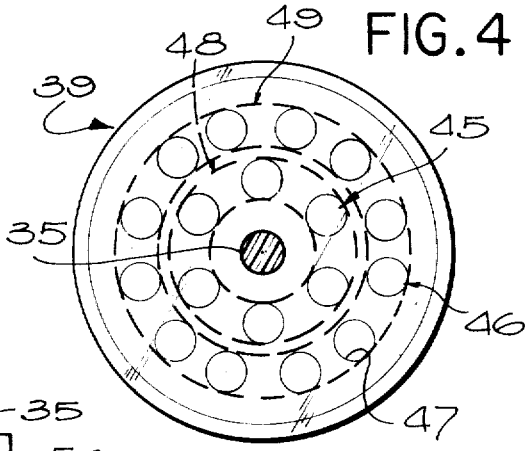
FIG. 3
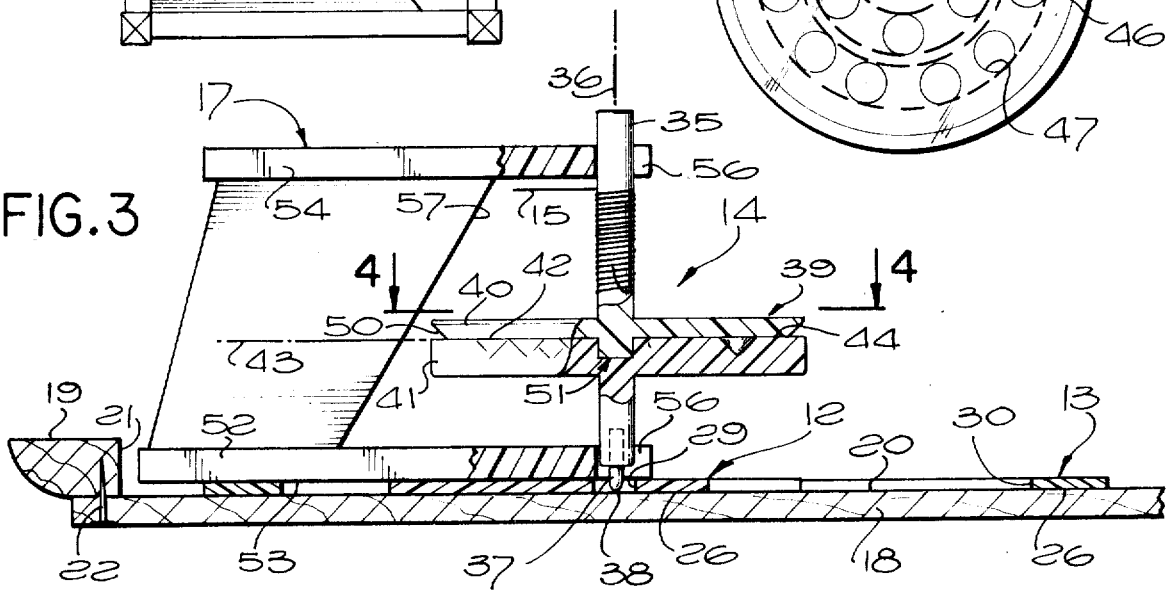

GAME TOY UTILIZING A SPINNING TOP

BACKGROUND OF THE INVENTION

This invention relates to a game toy of a type utilizing a spinning top as a primary element of the game.

There have of course been provided in the past various types of spinning tops which when placed in rapid rotation can spin for an extended period of time on an upwardly facing support surface by a gyroscope type action. The game of the present invention is of a type in which such a spinning top is utilized as a control part for producing movement of another element of the game structure.

There has heretofore been proposed a game in which a spinning top has been placed in rotation on the floor of a box like structure, with small bowling pin type elements placed on the floor at different locations, and with the scoring of the game being determined by how many of the pins are knocked down by the motion of the spinning top. The top is placed in operation by each player in turn, by placing its upper and lower ends within fixed locating recesses at an end of the box-like structure, and then pulling a string through an opening in the end of that structure to turn the top rapidly.

SUMMARY OF THE INVENTION

The general purpose of the present invention is to provide a toy which utilizes a spinning top in an extremely interesting manner providing a basis for many hours of enjoyment by one or more persons. At the same time, however, the various parts forming the game can be extremely simple in construction, and adapted to be manufactured at very low cost.

Structurally, the game includes a board having an upwardly facing surface on which one or more parts are movably supported, and a top which can be set in spinning motion on that surface and acts to shift the parts between different positions as the top itself moves laterally on the surface. A player may attempt to control movement of the top and the actuated shiftable part or parts by manually tilting the supporting board in different directions and to different extents. The game thus becomes a game of very substantial skill, in which a person after considerable practice can control the movement of the top and the actuated shiftable parts rather effectively.

One feature of the invention resides in the manner in which the top and a part actuated thereby are operatively interconnected to enable effective displacement of the part by the top. More particularly, this result may be attained by providing the controlled part with an opening through which a lower portion of the top extends downwardly into contact with the underlying supporting surface, in a relation leaving the top free for spinning motion relative to the shiftable part, but at the same time enabling the top to very effectively and positively control movement of the shiftable element by virtue of extension of the top through the mentioned opening. A second shiftable part is desirably disposed about the top and the part which contains the mentioned opening, with this second part preferably taking the form of a ring having freedom for movement relative to both the top and the first shiftable part.

Indicia may be provided for indicating various positions to which one or more of the shiftable parts may be moved by the top. In a preferred arrangement, indicia are provided on both of the shiftable parts, to indicate when those two parts are in one or more predetermined relative orientations. These indicia may include a circular series of markings formed on an outer annular part, and a coacting index marking formed on the inner part and adapted to in different positions point toward different ones of the outer markings.

Certain additional features of the invention relate to the preferred formation of the top itself to give a unique appearance while spinning. For this purpose, the top may have a portion carrying a series of circularly spaced colored regions of an upwardly concave configuration, in a relation such that, when the top is spinning, these various regions merge visually together to give the combined effect of an apparently annular upwardly facing colored groove on the top. Two such series of colored regions may be provided, with each series having regions of different colors acting together to form a combined color when the top is turning.

Another feature of the invention has to do with the provision of a holder which can be employed to temporarily hold the top as it is set in spinning motion.

BRIEF DESCRIPTION OF THE DRAWING

The above and other features and objects of the invention will be better understood from the following detailed description of the typical embodiment illustrated in the accompanying drawing in which:

FIG. 1 is a perspective view of a game device constructed in accordance with the invention;

FIG. 2 is a plan view of the board and the shiftable parts thereon shown after the top has ceased it spinning motion;

FIG. 3 is an enlarged fragmentary vertical section taken on line 3—3 of FIG. 1;

FIG. 4 is a further enlarged horizontal section through the top, taken on line 4—4 of FIG. 3; and FIG. 5 is a perspective representation of the board and top when used with a removable obstacle sheet.

DESCRIPTION OF THE PREFERRED EMBODIMENT

Referring first to FIG. 1, the game 10 illustrated in that figure includes a board device 11 on which there are movable supported two shiftable parts 12 and 13 whose movements on the board are controlled by a spinning top 14. The top is preferably started in its spinning motion by use of a string 15 having a pulling element 16 at one of its ends, with the top being located during the starting operation by a holder 17. Alternatively, the top may if desired be started manually, without use of the string 15 and holder 17.

The board device 11 includes a flat bottom wall or board proper designated by the number 18 in the figures, and preferably of rectangular shape, with a rail or fence member 19 extending rectangularly along the periphery of, and projecting upwardly above, the plane of upper smooth flat surface 20 of bottom wall 18, in a relation confining parts 12 and 13, and top 14, against movement laterally off of surface 20. Rail 19 may have an inner surface 21 extending upwardly perpendicular to surface 20, continuously about its entire periphery, with the rail being secured permanently to bottom board 18 in any convenient manner, as by nails or screws represented at 22 in FIG. 3. The rail may be formed of any suitable rigid material, such as wood, and the bottom board 18 may be formed of an appropriate rigid material, preferably a hard composition wall board having the smooth planar upper surface 20. To optimize the visual effects attained when top 14 spins, the upper surface 20 of board 18 may be painted different colors at different locations. In the particular arrangement illustrated, the portions 23 and 24 of surface 20 are painted red and blue respectively, and these two colors meet along an essentially diagonal line 25.

The two shiftable parts 12 and 13 may be cut from from fairly thick and stiff material, or if preferred may be molded to the illustrated shapes, with each of these parts having a planar undersurface 26 frictionally engaging and slidable across upper surface 20 of board 18. An appropriate thick cardboard, or a suitable stiff resinous plastic material, may typically be used in forming parts 12 and 13. These parts tend by their frictional engagement with surface 20 to remain in any positions to which they are moved on surface 20, but are fairly easily shiftable to changed positions on that surface by movement of top 14.

As seen best in FIG. 2, part 12 is preferably formed to the shape of a star as seen in plan view, having a series of points or projections 27 extending outwardly therefrom at circularly spaced locations, and with one of these points desirably carrying an index marking 28. A small opening 29 is formed at the center of star element 12, and may be circular as shown.

The second shiftable part 13 is preferably cut to the shape of a ring, whose inner annular edge 30 is of a diameter substantially greater than the diameter of a circle containing the outermost tips 31 of the points of star 12, so that the star is shiftable to different positions within ring 13, and is not necessarily at all times concentric with the ring. Between its inner annular edge 30 and its outer annular edge 32, ring 13 is marked off into a circular series of segments 33 designated by different numbers 34 typically ranging from 1 through 16.

With reference now to FIGS. 3 and 4, the top 14 includes a vertical shaft 35 having a spinning axis 36 and rigidly carrying at its lower end a pin 37 which contacts board surface 20 during the spinning motion. The lower end 38 of pin 37 is of small cross section to engage surface 20 only very locally, but preferably is not completely sharpened, and instead is of rounded configuration to enable the top to shift laterally on surface 20 fairly easily while spinning, in order to obtain the desired top induced actuation of parts 12 and 13. Tip element 37 is of a diameter slightly less than that of opening 29 in star part 12, to allow the top to spin freely while pin 37 is received within opening 29 and in contact with surface 20, while part 12 is retained against rotation by virtue of its frictional engagement with surface 20.

At a location intermediate its upper and lower ends, shaft 35 carries a mass structure 39, which is preferably formed as two upper and lower circular discs 40 and 41 disposed transversely of axis 36 and having adjacent surfaces at 42 meeting in a transverse plane 43. These discs 40 and 41, as well as shaft 35, are all preferably transparent, so that the colors of the board regions 23 and 24 are visible through mass structure 39. In order to enhance the visual appearance of the top in motion, the upper surface 44 of lower disc 41 is molded to have two circular series 45 and 46 of recesses or depressions 47 extending downwardly into the transparent material of disc 41. Each of these recesses 47 may be circular as seen in plan view (FIG. 4), and of either partial spherical or conical concave configuration. The walls of these depressions or recesses 47 are painted different colors, so that the colors of the different recesses in the inner series 45 merge together visually when the top is spinning to form a combined color, and similarly the colors of the various recesses of the outer series 46 merge together to form a combined color. For example, alternate ones of the recesses 47 of inner series 45 may be formed of two different primary colors, such as red and yellow, to combine during a spinning operation into an orange ring. Similarly, alternate pairs of recesses 47 in the outer series 46 may be blue and green respectively, to merge together in forming a combined color during rotation. Of particular importance is the fact that the novel recessed configuration of the colored areas 47 causes each of the circular series 45 and 46 of recesses, during spinning of the top, to combine visually in forming what appears to be a downwardly recessed circular groove, as represented by the broken lines 48 and 49 in FIG. 4. The appearance of these downwardly recessed annular grooves against the background of the colored regions 23 and 24 on the board is extremely attractive and eye catching. Added to this is the effect of an inclined annular edge 50 formed at the underside of the periphery of upper disc 40, which edge is painted an appropriate color, to form a ring about the two colored circular regions. It is comtemplated that shaft 35 may be formed sectionally if desired, with the upper section being molded integrally with and projecting upwardly above top disc 40, and the lower section being molded integrally with and projecting downwardly from lower disc 41 and containing a central recess or opening within which lower tip part 37 is rigidly carried. The upper section of the shaft may then also have a cylindrical portion 51 projecting downwardly a short distance beneath top disc 40, for reception within a cylindrical recess in bottom disc 41 to effectively center the upper and lower sections of the top, and allow them to be rigidly secured together by an appropriate cement at the location of shaft portion 51.

The top holder 17 has a lower base portion 52 with a planar undersurface 53 adapted to be placed on the upper surfaces of parts 12 and 13 as seen in FIG. 3. Spaced above base 52, the holder 17 has a similar upper portion 54, with these two parts being secured together by a vertical wall or rib 55. The inner extremities or ends of parts 52 and 54 form yokes containing horizontally facing or opening notches or recesses 56, which are aligned vertically with one another and are adapted to receive and effectively confine upper and lower ends of top shaft 35 in a manner locating that shaft and the entire top for rotation about axis 36. String 15 is wound about the upper portion of the shaft vertically between the top portion 54 of the holder and the mass structure 39 of the top. Wall 55 of the holder may have an inner inclined edge 57 which advances progressively away from axis 36 as it advances downwardly to allow for reception of the fairly large diameter mass portion 39 of the top.

In placing the apparatus described above in use, board 11 may first be placed in horizontal condition on an appropriate table or support surface 56, and the two shiftable parts 12 and 13 may be positioned on upper surface 20 of the board at essentially central positions with respect to peripheral rail 19. Holder 17 is then placed on the upper surfaces of parts 12 and 13 as seen in FIG. 3, with the inner vertically aligned yoke recesses 56 of the holder directly over and in vertical alignment with opening 29 in star part 12. String 15 is then wound about the upper portion of the shaft of top 14, and the top is positioned within the holder as seen in FIG. 3, with the lower tip element 37 of the top projecting downwardly through opening 29 and into contact with board surface 20. A player then retains holder 17 in the illustrated position with one hand, and pulls on string 15 through its enlargement 16 with the other hand, to commence spinning rotation of the top on surface 20 and within opening 29. After the rotation has started, holder 17 can be withdrawn from its position of contact with parts 12 and 13, and placed aside, following which the player grasps holder 11 and lifts it off of the table surface 56. By tilting board 11 manually in different directions, the player causes the top 14 to move gradually along the tilted surface 20 in desired controllable directions, by reason of the effect of gravity on the spinning top, and as the top moves it causes star part 12 to follow the motion of the top and shift to different positions on surface 20. When any of the points of star part 12 engage inner surface 30 of the second shiftable part 13, the top is then able to cause movement of outer ring 13 by force exerted through the star. The object of the game may be to cause the star point which carries index marking 28 to point toward a particular one of the scoring regions 33 on ring 13 when the top ceases its spinning motion and falls to an inoperative position such as that illustrated in broken lines in FIG. 2. For example, in the position of FIG. 2, the score of the particular player would be 9, since the index marking 28 is pointed toward the number 9 on ring 13.

FIG. 5 shows another use to which the board and top may be put. In this figure, the two shiftable parts 12 and 13 have been removed from the upper surface of the board, and in their place there has been positioned on upper surface 20 of board 11 a sheet of paper 58 of a size to fit closely within and be held in fixed position by peripheral rail 19. Sheet 58 has pasted or otherwise secured on its upper surface a number of circular or otherwise shaped elements 59, which project upwardly above the upper surface of sheet 58 far enough to deflect the spinning top 14 when its lower tip portion contacts any of the elements 59. The purpose of the game may then be to so control tilting movement of board 11 as to cause the top 14 while spinning to move through a predetermined pattern of movement about and between the various upwardly extending projections 59, Board 11 is made small enough in size to be easily held by a player in his hands while the top is spinning, and be easily tilted by the player to different positions and in any desired direction, as discussed. In a presently preferred embodiment of the invention, the size of playing surface 20 of the board corresponds to the dimensions of a standard sheet of letter sized paper, that is, 8½ inches by 11 inches.

While a certain specific embodiment of the present invention has been disclosed as typical, the invention is of course not limited to this particular form, but rather is applicable broadly to all such variations as fall within the scope of the appended claims.

I claim:

1. A game toy comprising:
a board having an upwardly facing surface;
a top which is adapted to spin on said board and is movable laterally to different positions as it spins; and
a shiftable part supported on said surface and containing an opening through which said top extends into spinning engagement with said surface in a relation moving said part to different positions on said surface in response to lateral movements of said top.

2. A game toy as recited in claim 1, in which said board has peripheral rails extending about said surface and projecting above the level thereof for retention of said spinning top and shiftable part on said surface.

3. A game toy as recited in claim 1, in which said board is manually tiltable to control the direction of movement of said top and part.

4. A game toy as recited in claim 1, including a second shiftable part supported on said surface and movable by said spinning top to different positions relative to the top and relative to said first shiftable part.

5. A game toy as recited in claim 1, including a second shiftable part supported on said surface and extending about said top and about said first shiftable part, and movable along said surface by said top and to different positions relative to the top and relative to said first shiftable part.

6. A game toy as recited in claim 1, including indicia for indicating one or more predetermined settings of said shiftable part.

7. A game toy as recited in claim 1, including a second shiftable part supported on said surface and movable by said spinning top to different positions relative to the top and relative to said first shiftable part, and indicia on said two shiftable parts for indicating one or more relative positions thereof.

8. A game toy as recited in claim 1, including a second shiftable part supported on said surface and extending about said top and about said first shiftable part, and movable along said surface by said top and to different positions relative to the top and relative to said first shiftable part, one of shiftable parts having a series of markings extending essentially circularly thereabout, and the other of said parts having marking means coacting with said markings of said one shiftable part to indicate different relative settings of the two parts.

9. A game toy as recited in claim 1, in which said shiftable part has a plurality of projections at circularly spaced locations projecting in different directions, there being a second shiftable part forming a ring disposed about said first shiftable part and movable relative thereto and relative to said top and said surface and having a series of circularly spaced markings coacting with said first shiftable part to indicate different relative settings thereof.

10. A game toy comprising:
a support structure having an upwardly facing surface;
a spinning top; and
first and second shiftable parts engaging said surface and movable therealong by said top;
said second shiftable part being disposed about said first shiftable part and movable to different positions relative thereto.

11. A game toy as recited in claim 10, including indicia on said first and second shiftable parts for indicating different relative positions thereof.

12. A game toy as recited in claim 10, including a series of markings extending essentially circularly along said second shiftable part, and marking means on said first shiftable part coacting with said series of markings on the second shiftable part to indicate different relative positions of the parts.

* * * * *